US005269587A

United States Patent [19]

Cunningham et al.

[11] Patent Number: 5,269,587

[45] Date of Patent: Dec. 14, 1993

[54] COMPACT PORTABLE COLLAPSIBLE INFANT SEAT

[75] Inventors: Jocelyn P. Cunningham, 3517 Herschel View Way, Cincinnati, Ohio 45208; Thomas J. Schmidlin, Jr., Cincinnati, Ohio

[73] Assignee: Jocelyn P. Cunningham, Cincinnati, Ohio

[21] Appl. No.: 817,520

[22] Filed: Jan. 7, 1992

[51] Int. Cl.[5] ..... A47D 1/02

[52] U.S. Cl. ..... 297/42; 247/16.1; 247/440.11; 247/452.13; 5/102; 5/98.3

[58] Field of Search ..... 297/45, 42, 16, 441, 297/457; 5/102, 103, 98.1, 98.2, 98.3, 655, 116

[56] References Cited

U.S. PATENT DOCUMENTS

| | | | |
|---|---|---|---|
| D. 282,791 | 3/1986 | Lockett, III et al. . | |
| D. 285,884 | 9/1986 | Wise . | |
| 289,465 | 4/1987 | Wise . | |
| 379,670 | 3/1988 | Whitehead . | |
| 595,386 | 12/1897 | Hall | 5/98.2 |
| 1,039,078 | 9/1912 | Arnold . | |
| 1,462,897 | 7/1923 | Barto | 5/98.3 |
| 1,480,591 | 1/1924 | Bakesef | 5/98.3 |
| 1,591,571 | 7/1926 | Stwalley | 5/98.2 |
| 2,006,823 | 7/1935 | Beeskow . | |
| 2,096,169 | 10/1937 | Friesner . | |
| 2,495,482 | 1/1950 | Rogatz | 297/441 |
| 2,690,792 | 10/1954 | Moss . | |
| 3,348,882 | 10/1964 | Chassaignac . | |
| 3,697,476 | 12/1954 | Tripodi et al. . | |
| 3,839,754 | 10/1974 | Hooper . | |
| 4,014,591 | 3/1977 | Gittings | 297/441 |
| 4,510,634 | 4/1985 | Diedrich | 5/98.3 |
| 4,553,786 | 11/1985 | Lockett, III et al. . | |
| 4,634,175 | 1/1987 | Wise . | |
| 4,670,920 | 6/1987 | Avni | 5/116 |
| 4,685,725 | 8/1987 | Helfrich | 297/45 |
| 4,801,176 | 1/1989 | Wolberg . | |

FOREIGN PATENT DOCUMENTS

| | | | |
|---|---|---|---|
| 768344 | 8/1934 | France | 5/98.3 |
| 61913 | 11/1926 | Sweden | 5/116 |

OTHER PUBLICATIONS

Consumer Safety Performance Specification, F 977-89 "Standard Consumer Safety Performance Specification for Infant Walkers".

Newspaper article from Cincinnati Enquirer, dated Oct. 5, 1990 "Playskool grows beyond toys".

Advertisement for Century Kanga-Rocka-Roo Adjustable Rocker Carrier, Feeder and Sleeper from Century Products Co.

Tyke-Hike Baby Rocker, undated.

3-In-1 Comfort Seat System, undated.

Infant Seats & Carry Beds, the Sourcebook, undated.

6126 Jane Bouncer, Marshall Baby Care Products, undated.

*Primary Examiner*—Peter M. Cuomo
*Assistant Examiner*—Flemming Saether
*Attorney, Agent, or Firm*—Frost & Jacobs

[57] ABSTRACT

There is provided a portable and collapsible seat for infants having a relatively compact closed condition for transportation and storage, and an open condition for use. The portable seat includes a collapsible frame having a pair of oppositely disposed longitudinal side rails, each with front and rear ends, a front support attached adjacent the respective front ends of the side rails, and a rear support attached adjacent the respective rear ends thereof. The supports extend downwardly and support the side rails in a rear-to-front inclined and parallel relationship when in open condition. The side rails are foldable outwardly between closed and open conditions. The seat further includes a flexible cradle selectively attached to the frame having a contoured recess for comfortably receiving and supporting the infant in use. The cradle further includes a head roll member situated adjacent and between respective rear ends of the side rails in use, and a leg roll member situated adjacent the respective front ends.

20 Claims, 4 Drawing Sheets

Fig. 3
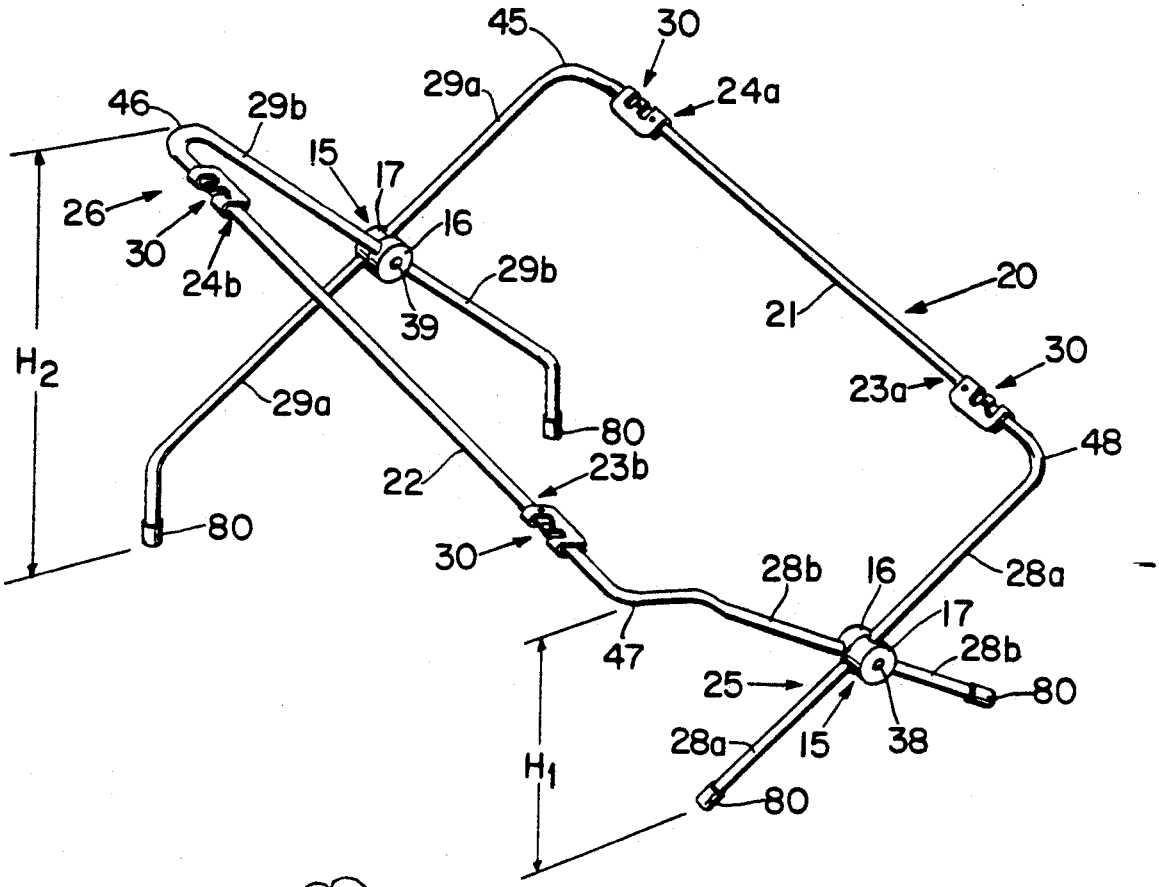
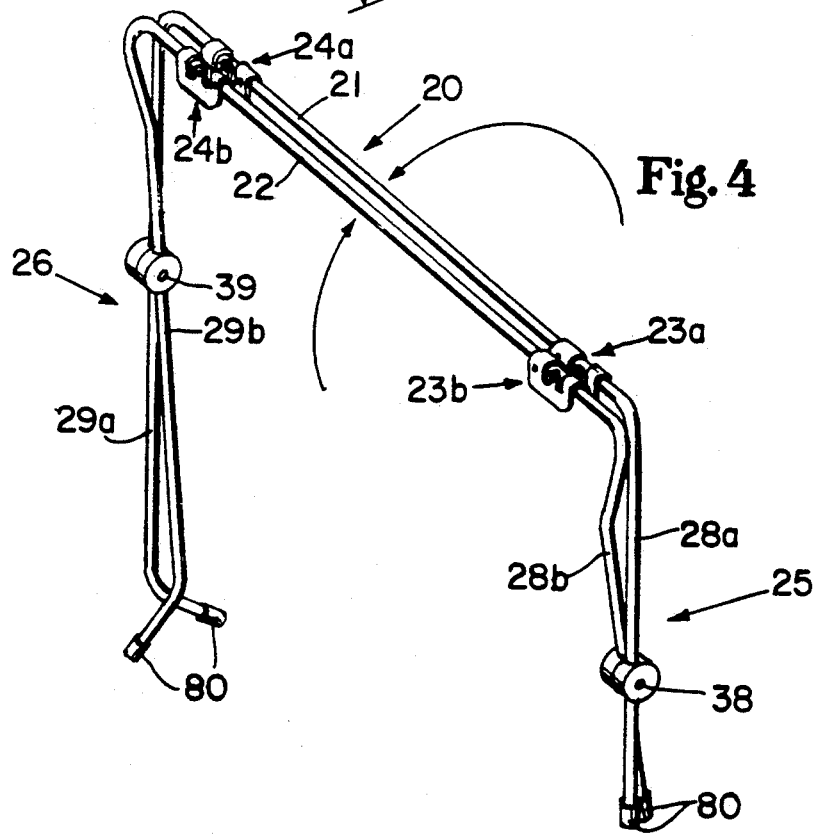
Fig. 4

COMPACT PORTABLE COLLAPSIBLE INFANT SEAT

TECHNICAL FIELD

This invention relates to an infant seat which is collapsible for easy portability, and, more particularly, to a portable infant seat which includes a flexible cradle attached to a collapsible frame which provide improved comfort in a lightweight portable device, and which can be substantially collapsed in vertical, longitudinal, and transverse dimensions into a compact closed condition for convenient storage and/or transportation.

BACKGROUND ART

While there are a variety of infant seats which are or have been available from various manufacturers, the vast majority can be classified into two general styles. One style of seat is of molded plastic, and often includes a padded liner structure which enables a rocking motion of the seat in use, and carrying features. One such molded plastic seat is marketed by Century Products Company of Macedonia, Ohio under the trademark Kanga-Rocka-Roo. Other examples of this seat style can be seen in R. Wise U.S. Pat. No. 5,634,175 and Des. No. 289,564 which issued to R. Wise. Some of these products also serve double duty as car seats for infants. While the molded plastic style seats perform many of their functions well, they are generally bulky, relatively heavy, and relatively expensive. While there is at least one molded plastic infant seat on the market which can be folded in half when not in use, these products remain relatively heavy, cumbersome, expensive, and too large for easy transportation and/or storage.

The other common type of infant seat available in the industry generally comprises a relatively heavy gauge wire frame having a cloth or similar material seat stretched over that frame. This general type of infant seat is also known as a "bouncer", as the wire frames of these devices often provide limited bounce when the baby moves therewithin. While these bouncer seats tend to provide a more flexible support for the infant, they are generally not foldable, and generally require dismantling for storage and/or transportation. These devices are also relatively expensive. Examples of the wire frame type seats are illustrated and described in W. Lockett III et al. U.S. Pat. No. 4,553,786 and Des. No. 282,791 which issued to W. Lockett III et al.

Other bouncer-type products are also available which substitute plastic or tubular frame parts for the heavy wire devices. Generally, however, these products do not collapse to a relatively compact package for storage and transportation, and their costs remain relatively high.

The problems of size and bulk of chair structures have been addressed in other industries such as illustrated in the folding chaise and cot of D. Wolberg U.S. Pat. No. 4,801,176. The Wolberg chaise is directed to addressing the problems of bulk in folding furniture, and features a foldable netting attached across lateral members of a rectangular frame which includes a plurality of foldable legs located at the head and foot of the frame. The Wolberg folding chaise, however, requires a relatively complex and cumbersome combination of hingedly connected parts and folding joints.

A similar collapsible chair is shown in H. Whitehead U.S. Pat. No. 379,670. Particularly, the Whitehead chair incorporates a pair of rectangular frame sections pivotally attached, and having a support member which locates one frame member relative to the other in various seating positions. The Whitehead device also includes cross-members which can be folded inwardly to reduce the lateral dimension of the chair to result in the collapsed condition shown in FIG. 4 of this patent. The Whitehead arrangement again relies on relatively complex interactions of a plurality of inner connected support members, and does not substantially reduce its length upon folding.

Other foldable and collapsible chair structures are shown in Friesner U.S. Pat. Nos. 2,096,169, Beeskow U.S. Pat. No. 2,006,823, Moss U.S. Pat. No. 2,690,792, and Tripodi, et al. U.S. Pat. No. 2,697,476. These foldable structures are collapsible in a vertical direction, and illustrate examples of relatively common folding chairs which have been available in the industry for years. While these chairs all include a portion formed of flexible material as the actual seat of the chair, such material is merely draped or hung on the rigid structure, which includes relatively complex interacting parts which in turn make the structures bulky, heavy, and expensive. Chassaignac U.S. Pat. No. 3,348,882 illustrates a chair which can be dismantled for transportation and storage, and which similarly includes relatively complex (and spring-loaded) interacting parts.

Consequently, it can be seen that heretofore there has not been available a relatively simple portable infant seat which can be substantially collapsed in vertical, longitudinal, and transverse dimensions into a substantially compact closed condition for storage and transportation. Moreover, folding structures available previously have required relatively complex and bulky mechanisms which would interfere with the low cost, low weight, and general convenience of an infant seat designed for quick and easy portability, with safety and reliability in mind.

DISCLOSURE OF THE INVENTION

It is an object of this invention to obviate the above-described problems and shortcomings of infant seats heretofore available in the industry.

It is another object of the present invention to provide an improved portable and collapsible seat for infants having a compact closed condition for quick and easy transportation and storage.

It is also an object of the present invention to provide an improved portable and collapsible infant seat which features optimum comfort and safety via a relatively simple structure which is easily and safely collapsed into a substantially compact condition for storage and transportation.

It is another object of the present invention to provide a portable infant seat including a flexible cradle portion which automatically and constantly adapts to the contours of an infant held therewithin, while improving comfort and adaptability for infants of varying sizes.

It is also an object of the present invention to provide an improved seat design which includes a flexible recess which cuddles a newborn, yet can be used with larger infants and includes flexible and comfortable head and leg supports adjacent the flexible recess to comfortably and automatically accommodate infants of larger sizes.

It is also an object of the present invention to provide an improved infant seat having a generally low profile in use, which provides a sufficiently steep angle of repose for the infant to allow a comfortable seating and feeding procedures without adjustment.

In accordance with one aspect of the present invention there is provided a portable and collapsible seat for infants having a relatively compact closed condition for transportation and storage, and an open condition for use. The portable seat includes a collapsible frame having a pair of oppositely disposed longitudinal side rails, each with front and rear ends, a front support attached adjacent the respective front ends of the side rails, and a rear support attached adjacent the respective rear ends thereof. The supports extend downwardly and support the side rails in a rear-to-front inclined and parallel relationship when in open condition. The side rails are foldable outwardly between closed and open conditions. The seat further includes a flexible cradle selectively attached to the frame having a contoured recess for comfortably receiving and supporting the infant in use. The cradle further includes a head roll member situated adjacent and between respective rear ends of the side rails in use, and a leg roll member situated adjacent the respective front ends. These head and leg roll members are mounted on the frame so as to become taught when the side rails are folded outwardly to their open condition, thereby limiting the outward foldability of the side rails and providing outwardly convex support rolls which extend laterally across the seat adjacent the front and rear ends. These convex support rolls comfortably and non-rigidly support the head and legs and feet of an infant, respectively, while the recess remains substantially flexible to comfortably adapt to the contours of the seated infant. The front and rear supports can be collapsed relative to the side rails, whereby the seat is substantially reduced in vertical, longitudinal, and transverse dimensions into a compact closed condition for storage and transportation.

In a preferred embodiment, the front and rear supports include one way hinge connections with the respective ends of the side rails to facilitate the collapse of the frame when desired. It is also preferred that the frame comprise substantially tubular side rails, and that each of the front and rear supports include a pair of tubular legs rotatably connected to one another below the side rails to accommodate the foldability of the side rails. The connection between each pair of legs Preferably includes a pinch-point elimination device for safety.

The flexible cradle is preferably formed as a unitary element, and is contemplated as being Provided as a washable, yet substantially non-stretch material The cradle will also be removable in most embodiments to facilitate washing procedures and/or replacement of the cradle itself.

BRIEF DESCRIPTION OF THE DRAWINGS

While the specification concludes with claims particularly pointing out and distinctly claiming the present invention, it is believed the same will be better understood from the following description taken in conjunction with the accompanying drawings in which:

FIG. 3 is a perspective view of the collapsible frame of the portable and collapsible seat shown in FIGS. 1 and 2;

FIG. 4 is a perspective view illustrating the initial folding sequence of the collapsible frame of FIG. 3, wherein the longitudinal side rails have been folded inwardly into closed or collapsed condition;

FIG. 6B is an enlarged partial perspective view similar to FIG. 6A, illustrating the folding movement of.

DETAILED DESCRIPTION OF THE INVENTION

Figure 1:
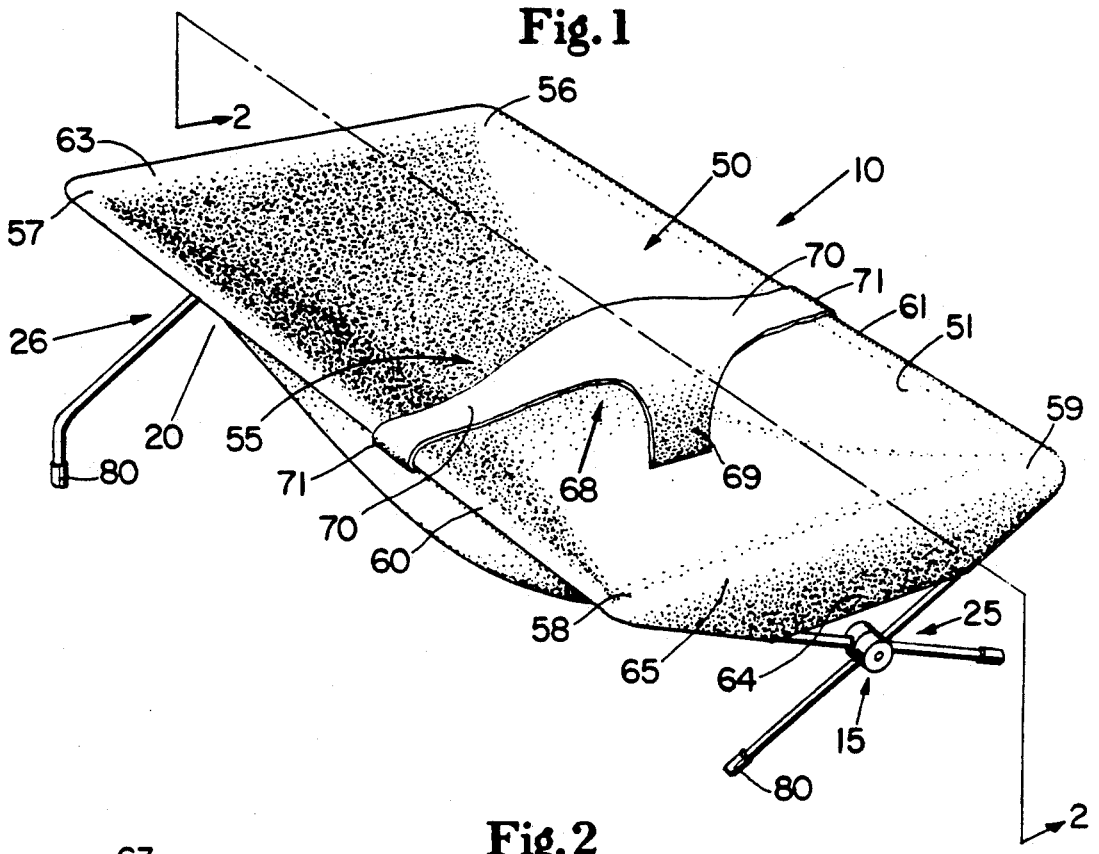
FIG. 1 is a perspective view of a portable and collapsible seat for infants made in accordance with the invention.
Figure 2:
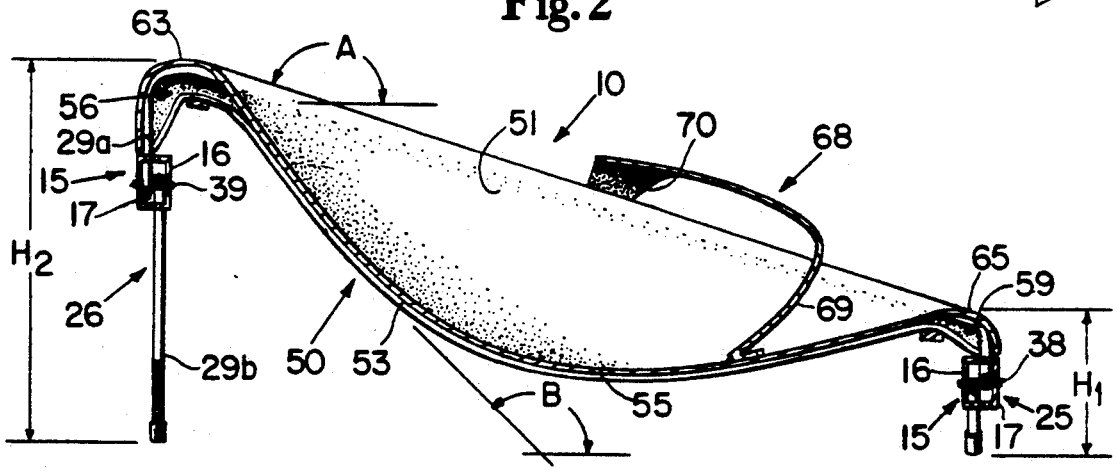
FIG. 2 is a cross-sectional view of the portable and collapsible seat of FIG. 1 taken along line 2—2 thereof.
Figure 5:
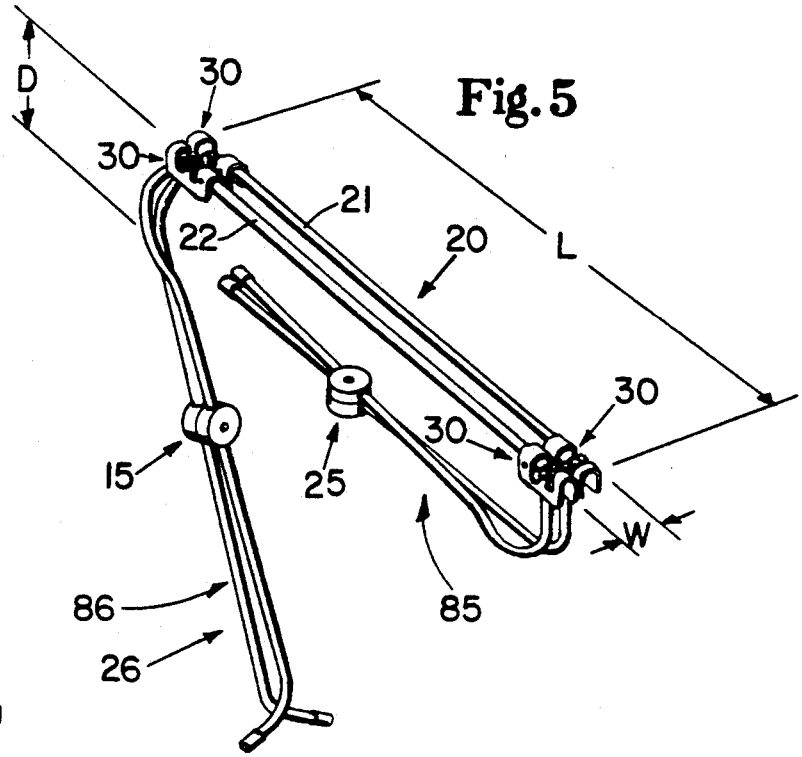
FIG. 5 is a perspective view illustrating further folding of the collapsible frame of FIG. 4, wherein the front and rear supports are folded longitudinally inwardly.

Referring now to the drawings in detail, wherein like numerals indicate the same elements throughout the views, FIG. 1 illustrates a preferred embodiment of a portable and collapsible seat 10 for infants of the present invention. FIGS. 2–7 provide further details of a preferred embodiment of the portable and collapsible seat of the present invention. Particularly, FIGS. 1 and 2 illustrate detail of seat 10 in an open or in-use condition, while FIGS. 3-5 illustrate details of the collapsibility of the subject infant seat, and its substantial reduction in vertical, longitudinal, and transverse dimensions when in its compact closed condition, as will be described in further detail below.

Turning now to FIG. 1, infant seat 10 is shown as including a collapsible frame 20 and a flexible cradle 50 selectively attached to frame 20. Collapsible frame 20 further comprises a front support 25 and a rear support 26, which extend downwardly to support frame 20 in a generally inclined position (e.g., inclined at angle A to the horizontal, as best seen in FIG. 2) when in open condition. Flexible cradle 50 includes a front surface 51 and a rear surface 53, with a contoured recess 55 formed in substantially the center of cradle 50 for comfortably receiving and supporting an infant in use.

As best seen in FIG. 3, collapsible frame 20 further comprises a pair of oppositely disposed longitudinal side rails 21 and 22, each having front and rear ends 23 and 24, respectively. Side rails 21 and 22 may preferably be provided as tubular members, but could easily have any cross-sectional shape designed to provide a relatively lightweight and sturdy support For clarity, the front and rear ends of side rail 21 are designated as **23*a* and 24*a*, respectively; while the front and rear ends of side rail 22 have been designated as 23*b* and 24*b***, respectively.

As can be seen, front support 25 is preferably attached adjacent the respective front ends (i.e., **23*a* and 23*b*) of the longitudinal side rails 21 and 22, and extends downwardly below the side rails to support the rails in rear-to-front generally inclined and parallel relative positions. Similarly, rear support 26 is attached adjacent the respective rear ends (i.e., 24*a* and 24*b*) of side rails 21 and 22, and likewise extends downwardly therebelow to support the side rails in an inclined and generally parallel relationship. FIG. 3 illustrates the open condition of collapsible frame 20, and it can be seen in this figure that rear support 26 situates the rear ends of side rails 21 and 22 at an approximate height $H_2$. Front support 25** is illustrated as supporting the front ends of side rails 21 and 22 at a lesser height $H_1$, whereby side rails 21 and 22 will have a generally rear-to-front inclination to the horizontal, as illustrated at angle A of FIG. 2.

Front support 25 further preferably comprises a pair of legs (28*a* and 2*b*) rotatably connected in cruciform relationship to accommodate the foldability of collapsible frame 20. Particularly, the rotatable connection, illustrated as a pin or similar rotatable joint connector 38, enables side rails 21 and 22 to be articulated inwardly and outwardly relative to one another between open condition (FIG. 3) and closed condition (FIG. 4). Rear support 26 similarly preferably comprises a pair of rear support legs (29*a* and 29*b*) rotatably connected in corresponding cruciform relationship via connector 39. While other forms and structures of front and rear supports 25 and 26 could equally be substituted, it is preferred to utilize the cruciform folding support arrangement featuring a cross-connection located somewhat downwardly from and below the inclined plane formed by the generally parallel side rails 21 and 22. In this way, the front and rear seat support structure will be effectively isolated or remote from contact with an infant within seat 10, and will provide superior support without compromising comfort and safety.

Front and rear support legs 28 and 29 are illustrated as generally tubular members, and may preferably include slide-resistant protective end caps 80. As with the side rails, the cross-sectional shape of legs 28 and 29 is not critical, although it is contemplated that hollow tubular members (e.g., aluminum, plastic, or composite materials) are preferred for strength and lightweight. Moreover, pinch point elimination devices 15 are provided adjacent the rotatable connection of each of the front and rear support leg pairs to minimize the potential for binding or pinching of a users hands or the like when support legs 28 and 29 are folded between open and closed position (as illustrated in FIG. 4).

Pinch point elimination devices 15 may preferably comprise a rotatable guard structure having a pair of enlarged inner and outer shell members 16 and 17, respectively, attached to the respective support legs, such as by the connectors 38 and 39. As best seen in the cross-sectional view of FIG. 2, inner and outer shells 16 and 17 may preferably comprise substantially hollow members (e.g., formed of high impact plastic or similar lightweight and durable material) designed to fit over the outer periphery of a support leg and to provide a rotatable protective covering preventing a user's fingers from becoming caught between adjacent support legs in a scissors-type fashion.

In addition to the inward foldability feature to reduce the lateral dimension of collapsible frame 20 (as illustrated in FIG. 4), it is further preferred to enable the collapse of both the front and rear supports 25 and 26 relative to side rails 21 and 22 for further reduction of both the vertical and longitudinal dimensions of seat 10, when in closed condition. In this regard, it is preferred to provide a plurality of one-way hinge devices (e.g., 30) or similar means for attaching the front and rear supports 25 and 26 to the respective front and rear ends of (23*a* and *b*, and 24*a* and *b*, respectively) of side rails 21 and 22. While hinges 30 are illustrated in FIGS. 3–5, the detail of preferred hinges is shown best in the enlarged views of FIGS. 6A and 6B.

Figure 6A:
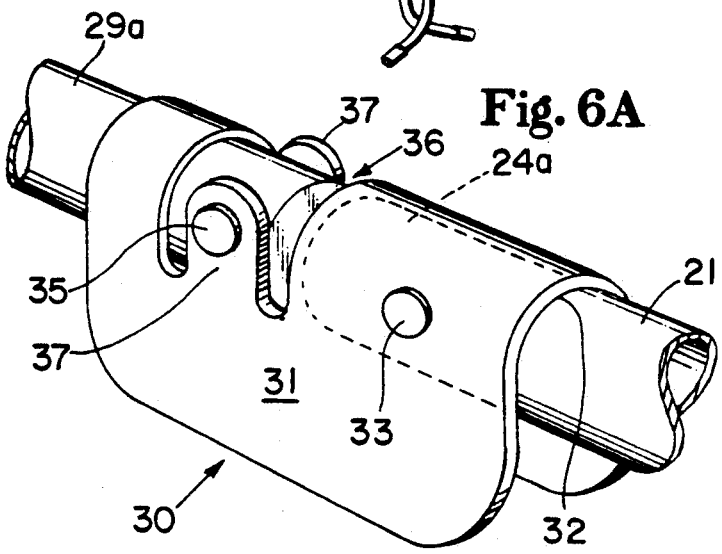
FIG. 6A is an enlarged partial perspective view of preferred one way folding hinges for the front and rear supports of the frame of the subject seat.
Figure 6B:
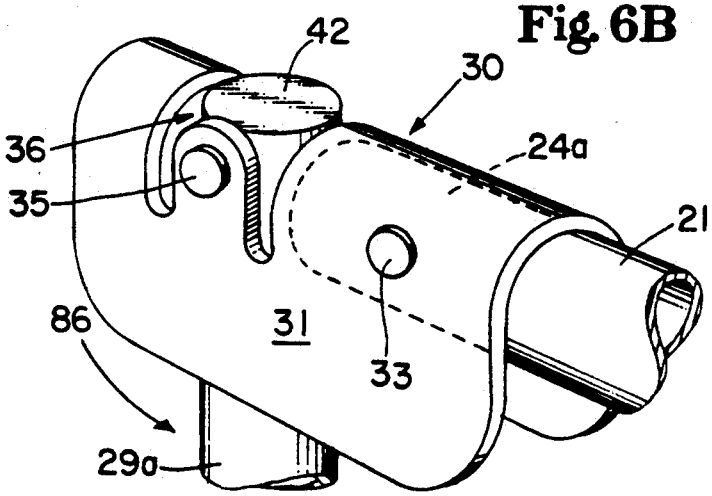

Turning now to FIGS. 6A and 6B, a typical preferred hinge 30 (such as also illustrated in the upper right portion of FIG. 3) is illustrated as comprising an inverted U-shaped member 31 having a longitudinal channel 32 formed along its upper inner surfaces for longitudinally receiving an end (rear end 24*a*) of a side rail (e.g., side rail 21) as well as the upper portions of a support leg (e.g., support leg 29*a*). U-shaped member 31 further comprises a saddle-shaped opening 36 which provides a pair of oppositely disposed support tangs 37 for rotatably connecting and supporting a support leg (e.g., leg 29*a*) via anchor or pin 35. The side rail (e.g., side rail 21) is further rigidly attached along longitudinal channel 32 by one or more anchor connectors or rivets (e.g., 33).

Following inward folding of side rails 21 and 22 to partially closed condition, as illustrated in FIG. 4, hinges 30 provide preferred means for enabling the collapse of both front and rear supports 25 and 26 relative to side rails 21 and 22, as best seen in FIG. 5 Particularly, FIG. 5 illustrates the rearward folding of front support 25 about hinges 30 (as indicated by the movement arrow 85), and the forward and upward folding of closed rear support 26 about its respective hinges 30 (as indicated by the movement arrow 86). The enlarged illustration of FIG. 6B also illustrates the movement about hinge 30 as it would appear relative to side rail 21 and rear support leg 29*a*. As will be understood, opening 36 allows relatively unencumbered rotation of the end of support leg (e.g., 29*a*) about its rotatable anchor 35.

As best illustrated in FIG. 6B, it is further preferred to provide the end of the rotatable support leg (e.g., 29*a*) with a smooth ended plug or cap 42 to minimize the potential for extraneous items becoming bound or caught within the opening 36 during rotation procedures. Alternatively, a protective cover or "bubble" (not shown) of plastic or the like might be fitted over opening 36 to further prevent extraneous items from entering this opening. It will be further understood that once seat 10 has been collapsed in the manner described above (and as illustrated in FIG. 5), seat 10 will have a resulting compact closed condition with a reduced width W, reduced length L, and reduced depth D for convenient storage and/or transportation. It is contemplated that seat 10 may have nominal dimensions of approximately 1½" (about 3.8 cm) by 5" (about 12.7 cm) by 17" (about 43.2 cm) when in its compacted closed condition to facilitate storage and transportation, such as below automobile seats, in diaper bags, or the like.

Returning now to FIGS. 1 and 2, flexible cradle 50 is illustrated as being selectively attached to frame 20 via a plurality of attachment pockets (e.g., 56–59). It is generally preferred that cradle 50 be easily detached from and removable from frame 20 to facilitate cleaning of cradle 50 and/or replacement thereof. As may be best understood by viewing FIGS. 1, 2 and 7 in combination, flexible cradle 50 is preferably formed as a unitary structure wherein front surface 51 is partially folded over on itself to form what might be best described as a bag-like or pillow-case like structure having an opening 67 substantially centrally located on the back side of flexible cradle 50. In this way, a plurality of pocket-like corners are formed about the periphery of flexible cradle 50, and these pockets (56, 57, 58 and 59) will preferably be so shaped and sized as to snuggly receive corresponding corner portions (e.g., 45–48) of collapsible frame 20.

Particularly, as best seen by comparing FIGS. 1 and 3, frame 20 is preferably fitted into cradle 50 through rear opening 67, and thereafter unfolded to open condition as illustrated in FIG. 1. Upon unfolding frame 20 against the rear surface 53 of flexible cradle 50, curved corners 45–48, respectively preferably extend outwardly into attachment pockets 56, 57, 58, and 59, respectively. Cradle 50 is preferably formed of a flexible, but substantially inextensible and unstretchable material, whereby as side rails 21 and 22 of frame 20 are folded outwardly to open condition, the portions of flexible cradle 50 adjacent the curved corners of frame 20 will become taut. Particularly, the inextensible nature of flexible cradle 50, at least adjacent the front and rear ends of seat 10, serves to limit the outward foldability of side rails 21 and 22, and acts to support seat 10 in open condition.

As seen best in FIGS. 1 and 2, the respective outward extension of curved corners 45–48 within attachment pockets 56–59, respectively, further provide a pair of front and rear outwardly convex support rolls extending laterally across seat 10 when fully opened. Particularly, head roll 63 is formed laterally across the rear end of seat 10 between curved corners 45 and 46 (and attachment pockets 56 and 57) to comfortably support the head of an infant within seat 10. Likewise, leg roll 65 is formed laterally across the front end of seat 10 between curved corners 47 and 48 (and between attachment pockets 58 and 59) to comfortably support the legs and feet of the infant.

It will be understood that roll 63 (and roll 65) is formed by a tightening of the material of cradle 50 between products 56 and 57 (or 58 and 59 for roll 65) upon opening of frame 20. In this way, the relatively inextensible material becomes taut and conforms to the respective rounded curved corners—thereby providing a rounded, non-rigid support across seat 10. Because front and rear supports 25 and 26 are below and effectively spaced from leg and head rolls 65 and 63, respectively, there are no rigid supports adjacent those rolls to interfere with comfortable support across these portions of seat 10. These non-rigid and flexible support rolls thereby comfortably accommodate infants of varying sizes without need for adjustment.

As illustrated, cradle 50 may include a front wrap section 64 which serves to further connect the oppositely disposed pockets 58 and 59 and to augment the limiting support of cradle 50 of front support mechanism 25. Similarly, rear wrap portion 62 may serve to augment the taut support features of attachment pockets 56 and 57 with respect to rear support device 26.

While the front and rear ends of cradle 50 become taught in open condition to effectively lock frame 20 in open condition and to provide the non-rigid support rolls 63 and 65, respectively, it is preferred that the contoured recess 55 of flexible cradle remain relatively supple at all times to continually, comfortably and automatically comply to the varying contours of the seated infant. Particularly, while the central side portions of flexible cradle 50 may include optional side wrap members (e.g., 60 and 61 shown in FIGS. 1 and 7) which wrap around portions of side rails 22 and 21, respectively, the design of flexible cradle 50 is preferably such as to isolate the portions becoming taut in open condition to only those areas adjacent head roll 63 and leg roll 65. In this regard, contoured recess 55 is provided with excess material across the lateral central portions of cradle 50 such that even in the fully open condition of seat 10, recess 55 remains relatively pliant and supple. Recess 55 thereby enables seat 10 to provide optimum comfort and flexibility, and further enables a variable angle of repose (e,g,m angle B shown in FIG. 2) for an infant within the seat.

As can be appreciated, and as best seen in the cross-sectional illustration of FIG. 2 the pliant, contoured recess 55 enables the angle of repose B of an infant within seat 10 to actually vary in use according to an infant's position, size and movements, and also to be generally greater than the angle of inclination A of the support rails of seat 10. In this way, the overall volume of space required for seat 10 in open condition is also minimized, while the angle of repose of an infant within the seat is optimized. Moreover, by enabling an angle of repose greater than the angle of inclination, the required maximum height ($H_2$) of seat 10 is minimized, and the overall stability of seat 10 is improved. Seat 10 can, therefore, be easily utilized for a variety of functions, including feeding.

As also illustrated in FIGS. 1 and 2, cradle 50 preferably further includes a generally T-shaped seat strap 68 having a centrally located crotch strap 69 anchored to front surface 51. A pair of oppositely disposed waist straps 70 extend outwardly from crotch strap 69, and can preferably be detachably connected adjacent side wraps 60 and 61, respectively, such as by hook and loop arrangements or the like. Such hook and loop attachment means may be preferred to further provide adjustability for seat strap 68 in order to accommodate infants of varying sizes and the like.

Figure 7:
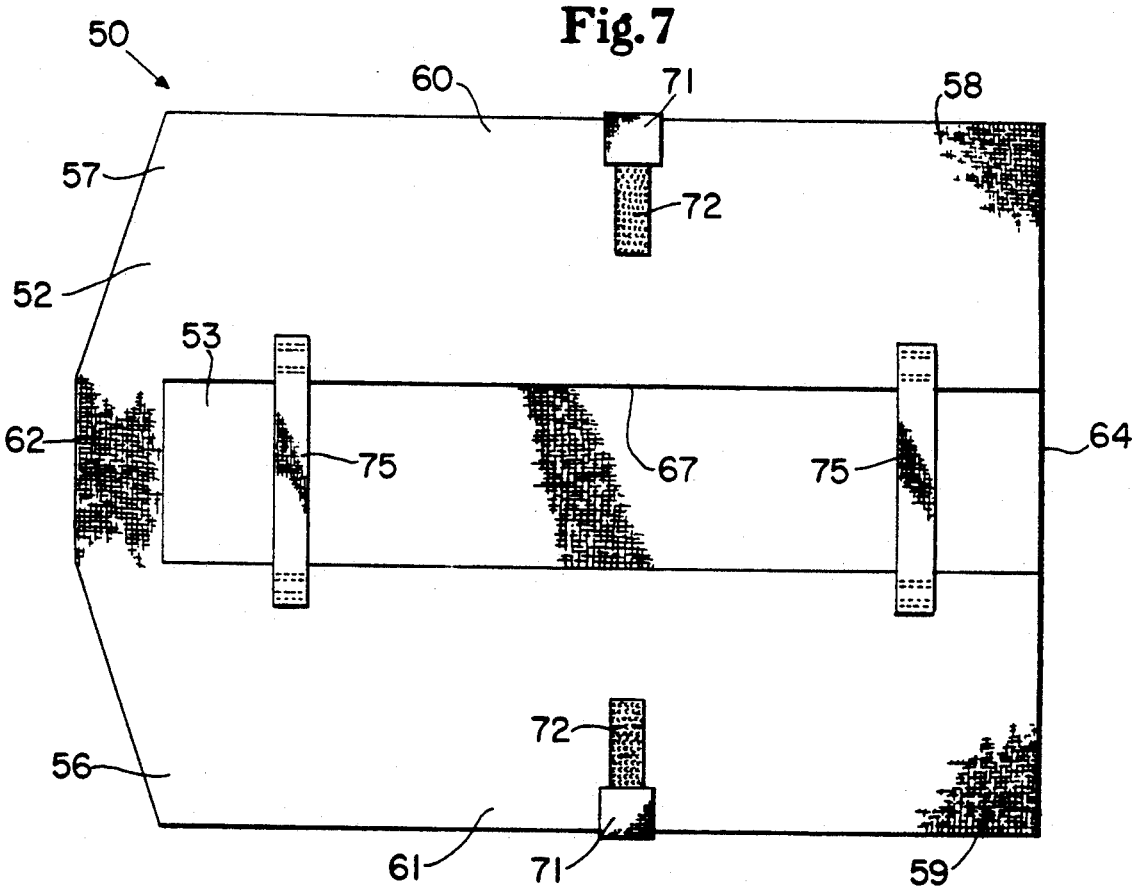
FIG. 7 is a rear elevational view of the flexible cradle of the portable and collapsible seat shown in FIGS. 1 and 2.

As seen best in FIG. 7, one or more cradle retainer straps 75 may also be provided to insure that flexible cradle 50 remains secured to frame 20 throughout opening, closing, storage, and transportation procedures. It is contemplated that straps 75 will be provided of a flexible, but substantially non-extensible material. When seat 10 is collapsed into its compact closed condition, adjustable seat strap 68 can be disconnected and wrapped around the entire collapsed unit to provide an effective retainer strap for the collapsed unit. Alternatively, a separate retainer strap and/or storage bag arrangement (not shown) might also be preferably provided.

Having shown and described the preferred embodiment of the present invention, further adaptions thereof can be accomplished by appropriate modifications by one of ordinary skill in the art without departing from the scope of the present invention. For example, an accessory bar (not shown) might be detachably connected between the side rails in open condition to provide play toys for the infant, or to connect a sun shade, protective screen or the like. Accordingly, the scope of this invention should be considered in terms of the following claims, and is understood not to be limited to the details of structure and function shown and described in the specification and drawings.

I claim:

1. A portable and collapsible seat for infants, said seat having a relatively compact closed condition for transportation and storage, and an open condition for use, said seat comprising:

a collapsible frame further comprising a pair of oppositely disposed longitudinal side rails having front and rear ends, a front support attached adjacent said respective front ends, and a rear support attached adjacent said respective rear ends, said supports extending downwardly below said side rails and supporting said side rails in a rear to front generally inclined and parallel relative position when in open condition, and said side rails foldable outwardly between closed and open conditions;

a flexible cradle further comprising a contoured recess for comfortably receiving and supporting an infant when said seat is in open condition, means for selectively attaching said cradle to said frame, a head roll member situated adjacent and between respective rear ends of said opposite side rails in use, and a leg roll member situated adjacent and between respective front ends of said opposite side rails in use, said head and leg roll members mounted on said frame so as to become taut when said side rails are folded outwardly to open condition, thereby limiting the outward foldability of said side rails and providing outwardly convex support rolls extending laterally across said seat adjacent the front and rear ends respectively to comfortably support the head, and legs and feet, respectively, of an infant therewithin, while said recess remains substantially supple to comfortably adapt to the contours of the seated infant; and means for enabling the collapse of both said front and rear support relative to said side rails, said enabling means comprising hinge connections of each of said supports adjacent corresponding ends of said side rails, said hinge connections enabling collapsible folding of said supports relative to said side rails whereby said seat is substantially reduced in vertical, longitudinal, and transverse dimensions into a compact closed condition.

2. The infant seat of claim 1, wherein said hinge connections comprise one way hinge connections between each of said supports and respective ends of said side rails, and said supports are collapsible longitudinally inwardly below said side rails only when said side rails are folded inwardly to closed condition.

3. The infant seat of claim 1, wherein said frame comprises substantially tubular side rails, and wherein said front and rear support each comprise a pair of legs connected to one another via a rotatable connection below said side rails to accommodate the foldability of said side rails.

4. The infant seat of claim 3, wherein the rotatable connection of said pairs of front and rear supports further comprises means for eliminating a pinch point hazard adjacent said rotatable connection.

5. The infant seat of claim 1, wherein said flexible cradle is removably attached to said frame.

6. The infant seat of claim 5, wherein said means for attaching said cradle to said frame comprises a plurality of pockets formed in said flexible cradle which removably slide over portions of said frame adjacent said front and rear ends of said side rails.

7. The infant seat of claim 5, wherein said flexible cradle is a unitary element formed of washable yet substantially non-stretch material.

8. The infant seat of claim 5, wherein at least a portion of said cradle is wrapped around said oppositely disposed longitudinal side rails, and at least one retainer strap is provided to retain said cradle on said frame when in closed condition.

9. The infant seat of claim 1, wherein said contoured recess provides an effective angle of repose for an infant in said seat which is variable and generally substantially greater than the rear to front incline of said side rails.

10. The infant seat of claim 1, further comprising an at least partially detachable seat strap which receives and secures an infant within said seat, as desired.

11. A portable and collapsible seat for infants, said seat having a relatively compact closed condition for transportation and storage, and an open condition for use, said seat comprising:

a collapsible frame comprising a pair of oppositely disposed parallel longitudinal side rails each having front and rear ends, a front support attached adjacent said respective front ends, and a rear support attached adjacent said respective rear ends, said supports extending downwardly below said side rails and supporting said side rails an inclined relative position when in open condition, and said side rails transversely foldable between closed and open conditions;

a unitary flexible cradle comprising a contoured recess for comfortably receiving and supporting an infant in use, means for removably attaching said cradle to said frame, a head roll member situated adjacent and between respective rear ends of said opposite side rails in use, and a leg roll member situated adjacent and between respective front ends of said opposite side rails in use, said head and leg roll members attached to said frame such that they become taut when said side rails are folded transversely outwardly to open condition, thereby limiting the outward foldability of said side rails and providing outwardly convex nonrigid support rolls extending laterally across said seat adjacent the front and rear ends respectively to comfortably support the head, and legs and feet, respectively, of an infant therewithin, while said recess remains substantially supple to comfortably and automatically comply to the varying contours of the seated infant; and means for enabling the collapse of both said front and rear supports relative to said side rails, said enabling means comprising hinge connections of each of said supports adjacent corresponding ends of said side rails, said hinge connections enabling collapsible folding of said supports relative to said side rails whereby said seat is substantially reduced in vertical, longitudinal, and transverse dimensions into a compact closed condition.

12. The infant seat of claim 11, wherein said hinge connections comprise one way hinge connections between each of said supports, and are located adjacent respective ends of said side rails, whereby said supports are collapsed longitudinally inwardly below said side rails.

13. The infant seat of claim 11, wherein said frame comprises substantially tubular side rails, and wherein said front and rear supports each comprise a pair of legs connected to one another in a rotatable cruciform arrangement below said side rails to accommodate the foldability of said side rails.

14. The infant seat of claim 13, wherein said pairs of front and rear support further comprises means for eliminating a pinch point hazard adjacent said rotatable connection.

15. The infant seat of claim 13, wherein each leg of said front and rear supports comprises a curved upper portion which is hingedly connected to its respective side rail end, and wherein said curved portions provide the convex conformation for said head and leg roll members as they are pulled taut between said curved portions adjacent said front and rear ends respectively.

16. The infant seat of claim 11, wherein said means for attaching said cradle to said frame comprises a plurality of pockets formed in said flexible cradle which removably slide over portions of said frame adjacent said front and rear ends of said side rails.

17. The infant seat of claim 11, wherein at least a portion of said cradle is wrapped around said oppositely disposed longitudinal side rails, and at least one flexible retainer strap is provided to retain said cradle on said frame when in closed condition.

18. The infant seat of claim 11, wherein said contoured recess provides an effective angle of repose for an infant in said seat which is variable and generally substantially greater than the rear to front incline of said side rails.

19. A portable and collapsible seat for infants, said seat having a relatively compact closed condition for transportation and storage, and an open condition for use, said seat comprising:

a collapsible frame comprising a pair of oppositely disposed parallel longitudinal side rails each having front and rear ends, a front support attached adjacent said respective front ends, and a rear support attached adjacent said respective rear ends, said supports each comprising a pair of legs rotatably connected in variable cruciform relation below said side rails to accommodate the foldability of said side rail and extending downwardly below said side rails to support said side rails in an inclined relative position when in open condition, and said side rails transversely foldable between closed and open conditions;

a unitary flexible cradle comprising a contoured recess for comfortably receiving and supporting an infant in use, means for removably attaching said cradle to said frame, a head roll member situated adjacent and between respective rear ends of said opposite side rails in use, and a leg roll member situated adjacent and between respective front ends of said opposite side rails in use, said head and leg roll members attached to said frame such that they become taut when said side rails are folded transversely outwardly to open condition, thereby limiting the outward foldability of said side rails and providing outwardly convex non-riding support rolls extending laterally across said seat adjacent the front and rear ends respectively to comfortably support the head, and legs and feet, respectively, of an infant therewithin, while said recess remains substantially supple to comfortably and automatically adapt to the varying contours of the seated infant; and means for enabling the collapse of both said front and rear supports relative to said side rails, said enabling means comprising hinge connections of each of said supports adjacent corresponding ends of said side rails, said hinge connections enabling collapsible folding of said supports relative to said side rails whereby said seat is substantially collapsed in vertical, longitudinal, and transverse dimensions into a compact closed condition.

20. The infant seat of claim 19, further comprising an at least partially detachable seat strap which receives and secures an infant within said seat, as desired.

* * * * *

UNITED STATES PATENT AND TRADEMARK OFFICE

CERTIFICATE OF CORRECTION

PATENT NO. : 5,269,587

DATED : December 14, 1993

INVENTOR(S) : Jocelyn P. Cunningham et al

It is certified that error appears in the above-indentified patent and that said Letters Patent is hereby corrected as shown below:

Column 9, line 23, "support" should read --supports--.
line 39, "support" should read --supports--.
Column 10, line 57, "support" should read --supports--.
Column 12, line 11, "non-riding" should read --non-rigid--.

Signed and Sealed this

Tenth Day of May, 1994

Bruce Lehman

*Attest:*

BRUCE LEHMAN

*Attesting Officer*

*Commissioner of Patents and Trademarks*